US011512819B1

(12) United States Patent
Xia et al.

(10) Patent No.: US 11,512,819 B1
(45) Date of Patent: Nov. 29, 2022

(54) SHEARABLE LAMP STRIP

(71) Applicant: GUANGDONG OML TECHNOLOGY CO., LTD., Guangdong (CN)

(72) Inventors: Hongbo Xia, Guangdong (CN); Chao Deng, Guangdong (CN); Qijun Kuang, Guangdong (CN)

(73) Assignee: Guangdong OML Technology Co., Ltd., Guangdong (CN)

( * ) Notice: Subject to any disclaimer, the term of this patent is extended or adjusted under 35 U.S.C. 154(b) by 0 days.

(21) Appl. No.: 17/670,774

(22) Filed: Feb. 14, 2022

(30) Foreign Application Priority Data

Jul. 1, 2021 (CN) ..... 202121504627.2

(51) Int. Cl.

| | |
|---|---|
| ***F21S 4/28*** | (2016.01) |
| ***F21V 23/02*** | (2006.01) |
| *F21Y 113/13* | (2016.01) |
| *F21Y 103/10* | (2016.01) |
| *F21Y 115/10* | (2016.01) |

(52) U.S. Cl.
CPC ..... *F21S 4/28* (2016.01); *F21V 23/02* (2013.01); *F21Y 2103/10* (2016.08); *F21Y 2113/13* (2016.08); *F21Y 2115/10* (2016.08)

(58) Field of Classification Search
CPC ..... F21S 4/28; F21V 23/02; F21Y 2103/10; F21Y 2113/13; F21Y 2115/10
See application file for complete search history.

(56) References Cited

U.S. PATENT DOCUMENTS 8,680,773 B2 * 3/2014 Hering ..... H01R 31/06 315/200 R
2006/0198143 A1 * 9/2006 Cheung ..... H05B 45/10 362/249.06

(Continued)

FOREIGN PATENT DOCUMENTS

CN 209116070 U * 7/2019
CN 111288312 A * 6/2020
CN 211509415 U * 9/2020

OTHER PUBLICATIONS

English Translation of CN211509415U; Zheng; Sep. 2020.*
English Translation of CN-111288312-A; Zheng; Jun. 2020.*
English Translation of CN-209116070-U; Li; Jul. 2019.*

*Primary Examiner* — Rajarshi Chakraborty
*Assistant Examiner* — Glenn D Zimmerman
(74) *Attorney, Agent, or Firm* — Notaro, Michalos & Zaccaria P.C.; John S. Economou

(57) ABSTRACT

Disclosed is a shearable lamp strip, comprising a light-emitting body, a first bus, a second bus, an outer sheath and a shearing indication area, wherein the light-emitting body comprises a substrate, and a first LED lamp bank and a second LED lamp bank which are sequentially arranged on the substrate along a length direction of the substrate, the first LED lamp bank is electrically connected with the first bus and the second bus respectively, the second LED lamp bank is electrically connected with the first bus and the second bus respectively, the outer sheath is wrapped on the light-emitting body, the first bus and the second bus, the shearing indication area is arranged on the outer sheath and located between the first LED lamp bank and the second LED lamp bank, the shearing indication area at least comprises a first shearing mark and a second shearing mark.

8 Claims, 2 Drawing Sheets

(56) References Cited

U.S. PATENT DOCUMENTS

| | | | | |
|---|---|---|---|---|
| 2017/0045187 | A1* | 2/2017 | Li | B29C 48/0022 |
| 2019/0093870 | A1* | 3/2019 | Liu | H05B 45/40 |
| 2021/0100083 | A1* | 4/2021 | McRae | H05B 45/46 |

* cited by examiner

SHEARABLE LAMP STRIP

TECHNICAL FIELD

The present disclosure relates to the field of light source technologies, and more particularly, to a shearable lamp strip.

BACKGROUND

A traditional lamp strip generally comprises a substrate, a positive bus and a negative bus, a plurality of LED lamp banks is arranged on the substrate along a length direction, and each LED lamp bank is respectively connected with the positive bus and the negative bus, so that the plurality of LED lamp bank is connected in parallel with each other. The substrate, the positive bus, the negative bus and the LED lamp banks may also be wrapped with an outer sheath. When in use, a user may shear between any two adjacent LED lamp banks according to actual situations, and due to parallel connection of the plurality of LED lamp banks, the sheared lamp strip may still be operated stably. However, in practical application, after shearing the lamp strip into two sections, it is necessary to trim end portions of the lamp strip to expose the positive bus and the negative bus for connection with an external power supply. However, it is difficult for the user to grasp a position for further trimming, which may damage a circuit on the substrate and damage the lamp strip.

SUMMARY

The present disclosure aims to solve at least one of the technical problems in the prior art. Therefore, the present disclosure provides a shearable lamp strip, which has an indication and is convenient for shearing.

A shearable lamp strip according to an embodiment in a first aspect of the present disclosure comprises: a light-emitting body comprising a substrate, and a first LED lamp bank and a second LED lamp bank which are sequentially arranged on the substrate along a length direction of the substrate; a first bus and a second bus both arranged along the length direction of the substrate, wherein the first LED lamp bank is electrically connected with the first bus and the second bus respectively, and the second LED lamp bank is electrically connected with the first bus and the second bus respectively; an outer sheath wrapped on the light-emitting body, the first bus and the second bus; and a shearing indication area arranged on the outer sheath and located between the first LED lamp bank and the second LED lamp bank, wherein the shearing indication area at least comprises a first shearing mark and a second shearing mark, and the first shearing mark and the second shearing mark are arranged at an interval along the length direction of the substrate.

The shearable lamp strip according to the embodiment of the present disclosure at least has the following beneficial effects: for the lamp strip of the present disclosure, the shearing indication area between the first LED lamp bank and the second LED lamp bank is provided with the first shearing mark and the second shearing mark, a user may shear at the first shearing mark first, so as to shear the lamp strip, and since the first LED lamp bank and the second LED lamp bank are both electrically connected with the first bus and the second bus respectively, parallel connection is formed. Therefore, the lamp strip is sheared into two parts, and each part can be operated normally, while the user may further shear one part of the lamp strip continuously according to a position of the second shearing mark, and may shear and peel off a part of the outer sheath without damaging internal substrate and circuit, so that the first bus and the second bus are exposed for connection with an external power supply.

According to some embodiments of the present disclosure, the first bus and the second bus are respectively located at two sides of the length direction of the substrate, and a gap exists between the first bus and the substrate and a gap exists between the second bus and the substrate.

According to some embodiments of the present disclosure, the first LED lamp bank comprises a first LED lamp string and a second LED lamp string which are connected in anti-parallel, and the first LED lamp string and the second LED lamp string emit different colors of light from each other.

According to some embodiments of the present disclosure, the first LED lamp string comprises a plurality of first LED lamp beads sequentially connected in series, the second LED lamp string comprises a plurality of second LED lamp beads sequentially connected in series, and the first LED lamp bead and the second LED lamp bead emit different colors of light from each other.

According to some embodiments of the present disclosure, a first resistor is connected in series between at least two adjacent first LED lamp beads, and a second resistor is connected in series between at least two adjacent second LED lamp beads.

According to some embodiments of the present disclosure, the first LED lamp bank comprises a plurality of LED assemblies sequentially connected in series, the LED assembly comprises a first LED string circuit and a second LED string circuit connected in anti-parallel, the first LED string circuit comprises a plurality of first LED beads sequentially connected in series, the second LED string circuit comprises a plurality of second LED beads sequentially connected in series, and the first LED lamp bead and the second LED lamp bead emit different colors of light from each other.

According to some embodiments of the present disclosure, a third resistor is connected in series between at least two adjacent LED assemblies.

According to some embodiments of the present disclosure, the first LED lamp bank comprises a plurality of LED units sequentially connected in series, the LED unit comprises a first LED lamp bead and a second LED lamp bead which are connected in anti-parallel, and the first LED lamp bead and the second LED lamp bead emit different colors of light from each other.

According to some embodiments of the present disclosure, a fourth resistor is connected in series between at least two adjacent LED units.

According to some embodiments of the present disclosure, the LED unit further comprises a dam arranged on the substrate and a glue filling layer, the first LED lamp bead and the second LED lamp bead are arranged in an area surrounded by the dam, and the glue filling layer covers the first LED lamp bead and the second LED lamp bead.

The additional aspects and advantages of the present disclosure will be partially provided in the following description, and will partially be apparent in the following description, or learned by practice of the present disclosure.

BRIEF DESCRIPTION OF THE DRAWINGS

The above and/or additional aspects and advantages of the present disclosure will be apparent and easily understood from the descriptions of the embodiments with reference to the following accompanying drawings, wherein.

Figure 1:
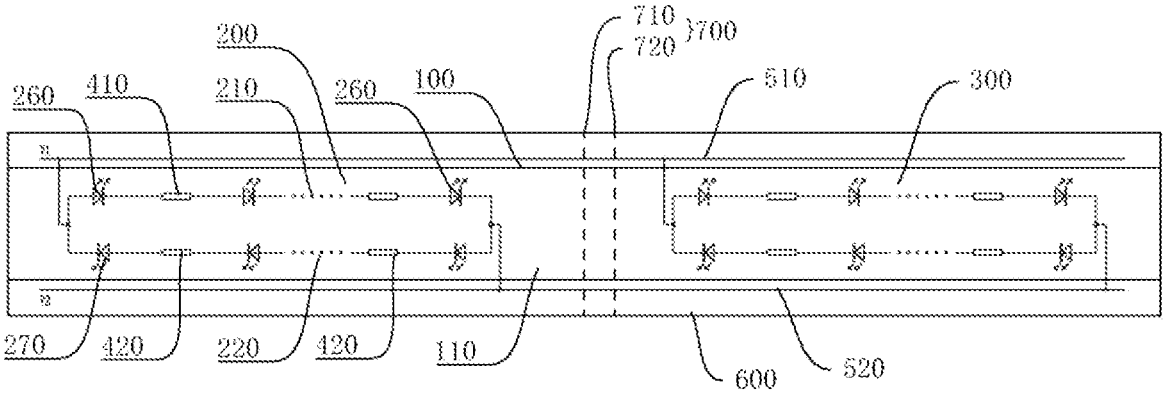
FIG. 1 is a schematic diagram of a circuit of a lamp strip of the present disclosure according to first embodiment.

Reference numerals: 100 refers to light-emitting body, 110 refers to substrate, 200 refers to first LED lamp bank, 210 refers to first LED lamp string, 220 refers to second LED lamp string, 230 refers to LED assembly, 240 refers to first LED string circuit, 250 refers to second LED string circuit, 260 refers to first LED lamp bead, 270 refers to second LED lamp bead, 300 refers to second LED lamp bank, 410 refers to first resistor, 420 refers to second resistor, 430 refers to third resistor, 440 refers to fourth resistor, 510 refers to first bus, 520 refers to second bus, 600 refers to outer sheath, 700 refers to shearing indication area, 710 refers to first shearing mark, and 720 refers to second shearing mark.

DETAILED DESCRIPTION

The embodiments of the present disclosure are described in detail hereinafter, and examples of the embodiments are shown in the accompanying drawings, wherein the same or similar reference numerals throughout the accompanying drawings denote the same or similar elements or elements having the same or similar functions. The embodiments described hereinafter with reference to the accompanying drawings are exemplary, and are only used to explain the present disclosure, but should not be understood as limiting the present disclosure.

In the description of the present disclosure, it should be understood that the orientation or position relationship indicated by the terms "up", "down", "front", "rear", "left", "right", "vertical", "horizontal", "top", "bottom", "inner", "outer", and the like is based on the orientation or position relationship shown in the accompanying drawings, it is only for the convenience of description of the present disclosure and simplification of the description, and it is not to indicate or imply that the indicated device or element must have a specific orientation, and be constructed and operated in a specific orientation. Therefore, the terms should not be understood as limiting the present disclosure.

In the description of the present disclosure, "several" refers to being one or more, "multiple" refers to being more than two, and "greater than", "less than", "more than", and the like are understood as not including this number, while "above", "below", "within", and the like are understood as including this number. If there are descriptions of "first" and "second", it is only for the purpose of distinguishing technical features, and should not be understood as indicating or implying relative importance, implicitly indicating the number of the indicated technical features or implicitly indicating the order of the indicated technical features.

In the description of the present disclosure, it should be noted that the terms "installation", "connected" and "connection" should be understood in a broad sense unless otherwise specified and defined. For example, they may be fixed connection, removable connection or integrated connection; may be mechanical connection or electrical connection; and may be direct connection, or indirect connection through an intermediate medium, and connection inside two elements. The specific meanings of the above terms in the present disclosure may be understood in a specific case by those of ordinary skills in the art.

As shown in FIG. 1 to FIG. 5, a shearable lamp strip according to an embodiment in a first aspect of the present disclosure comprises a light-emitting body 100, a first bus 510, a second bus 520, an outer sheath 600 and a shearing indication area 700. The light-emitting body 100 comprises a substrate 110, and a first LED lamp bank 200 and a second LED lamp bank 300 which are sequentially arranged on the substrate 110 along a length direction of the substrate 110. The first bus 510 and the second bus 520 are both arranged along the length direction of the substrate 110, wherein the first LED lamp bank 200 is electrically connected with the first bus 510 and the second bus 520 respectively, and the second LED lamp bank 300 is electrically connected with the first bus 510 and the second bus 520 respectively. The outer sheath 600 is wrapped on the light-emitting body 100, the first bus 510 and the second bus 520. The shearing indication area 700 is arranged on the outer sheath 600 and located between the first LED lamp bank 200 and the second LED lamp bank 300, wherein the shearing indication area 700 at least comprises a first shearing mark 710 and a second shearing mark 720, and the first shearing mark 710 and the second shearing mark 720 are arranged at an interval along the length direction of the substrate 110.

Specifically, the first shearing mark 710 and the second shearing mark 720 may both be fluorescent materials arranged in the transparent outer sheath 600, and may be set as dashed lines or other patterns surrounding the substrate 110. Alternatively, the first shearing mark 710 and the second shearing mark 720 may also be paintings arranged on a surface of the outer sheath 600. Specifically, patterns of the first shearing mark 710 and the second shearing mark 720 may be different to facilitate differentiation.

It should be noted that, with extension of the lamp strip, a third lamp bank, a fourth lamp bank and even more lamp banks may be sequentially arranged.

Figure 2:
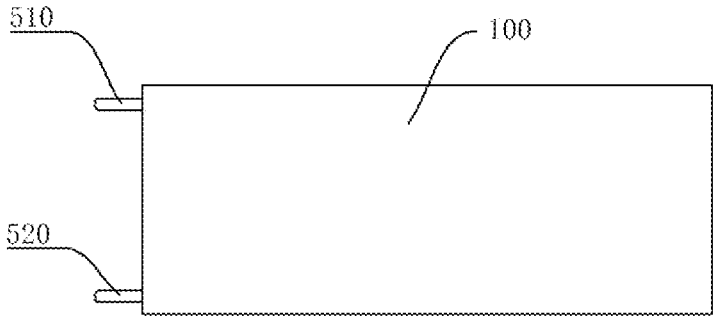
FIG. 2 is a schematic structural diagram of the lamp strip of the present disclosure after shearing according to one of embodiments.

For the lamp strip of the present disclosure, the shearing indication area 700 between the first LED lamp bank 200 and the second LED lamp bank 300 is provided with the first shearing mark 710 and the second shearing mark 720, a user may shear at the first shearing mark 710 first, so as to shear the lamp strip, and since the first LED lamp bank 200 and the second LED lamp bank 300 are both electrically connected with the first bus 510 and the second bus 520 respectively, parallel connection is formed. Therefore, the lamp strip is sheared into two parts, and each part can be operated normally, while the user may further shear one part of the lamp strip continuously according to a position of the second shearing mark 720, and may shear and peel off a part of the outer sheath 600 without damaging internal substrate 110 and circuit, so that the first bus 510 and the second bus 520 are exposed, as shown in FIG. 2, for connection with an external power supply.

Figure 5:
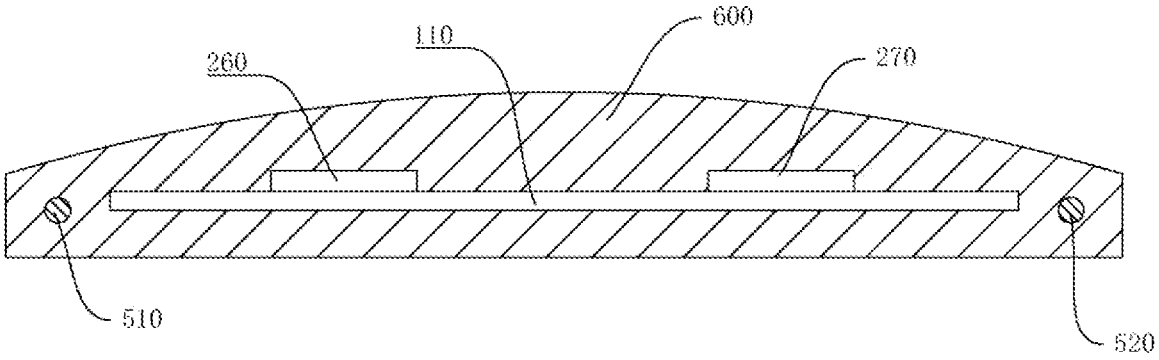
FIG. 5 is a cross-section view of the lamp strip of the present disclosure according to one of embodiments.

In some embodiments of the present disclosure, as shown in FIG. 5, the first bus 510 and the second bus 520 are respectively located at two sides of the length direction of the substrate 110, and a gap exists between the first bus 510 and the substrate 110 and a gap exists between the second bus 520 and the substrate 110.

Specifically, the substrate 110 may be provided with a welding position near the first LED lamp bank 200 and the second LED lamp bank 300, a leading wire may be connected onto the welding position, and the leading wire extends to be connected with the first bus 510 or the second bus 520, while the gap exists between the first bus 510 and the substrate 110 and the gap exists between the second bus 520 and the substrate 110 may be filled with the outer sheath 600. The outer sheath 600 is generally made of an insulating material such as resin or rubber, and may prevent the first bus 510 and the second bus 520 from being short-circuited with other positions on the substrate 110, thus improving an operation stability.

However, in order to be able to emit multiple colors on the same lamp strip, this design provides multiple embodiments for implementation.

In some embodiments of the present disclosure, as shown in FIG. 1, the first LED lamp bank 200 comprises a first LED lamp string 210 and a second LED lamp string 220 which are connected in anti-parallel, and the first LED lamp string 210 and the second LED lamp string 220 emit different colors of light from each other.

In a similar way, the second LED lamp bank 300 may also comprise the first LED lamp string 210 and the second LED lamp string 220 connected in anti-parallel, and the first LED lamp string 210 and the second LED lamp string 220 emit different colors of light from each other.

Specifically, the first LED lamp string 210 comprises a plurality of first LED lamp beads 260 sequentially connected in series, the second LED lamp string 220 comprises a plurality of second LED lamp beads 270 sequentially connected in series, and the first LED lamp bead 260 and the second LED lamp bead 270 emit different colors of light from each other. A positive electrode of the first LED lamp string 210 is connected with the first bus 510, and a negative electrode of the first LED lamp string 210 is connected with the second bus 520. A positive electrode of the second LED lamp string 220 is connected with the second bus 520, and a negative electrode of the second LED lamp string 220 is connected with the first bus 510.

The external power supply is connected to the first bus 510 and the second bus 520 respectively, the external power supply may form a power supply loop with the first bus 510, the light-emitting body 100 and the second bus 520, and the external power supply may be switched and outputted to the positive and negative electrodes of the first bus 510 and the second bus 520, so as to control the first LED lamp string 210 and the second LED lamp string 220 to be switched on and off respectively.

The colors of light emitted by the first LED string 210 and the second LED string 220 are different from each other. The first LED string 210 is switched on and the second LED string 220 is switched off, or the first LED string 210 is switched off and the second LED string 220 is switched on, or on-off frequencies of the first LED string 210 and the second LED string 220 are adjusted, which may all make the whole light strip emit different colors of light.

In some embodiments of the present disclosure, a first resistor 410 is connected in series between at least two adjacent first LED lamp beads 260, and a second resistor 420 is connected in series between at least two adjacent second LED lamp beads 270.

Specifically, in the first LED lamp string 210, the first resistor 410 is connected in series between every two adjacent first LED lamp beads 260. A welding joint at a negative electrode of one first LED lamp bead 260 is connected with a welding joint at one end of the first resistor 410, and a welding joint at a positive electrode of the other first LED lamp bead 260 is connected with a welding joint at the other end of the first resistor 410

The first resistor 410 and the second resistor 420 can both limit currents, thus protecting operation of the first LED lamp beads 260 and the second LED lamp beads 270.

Figure 3:
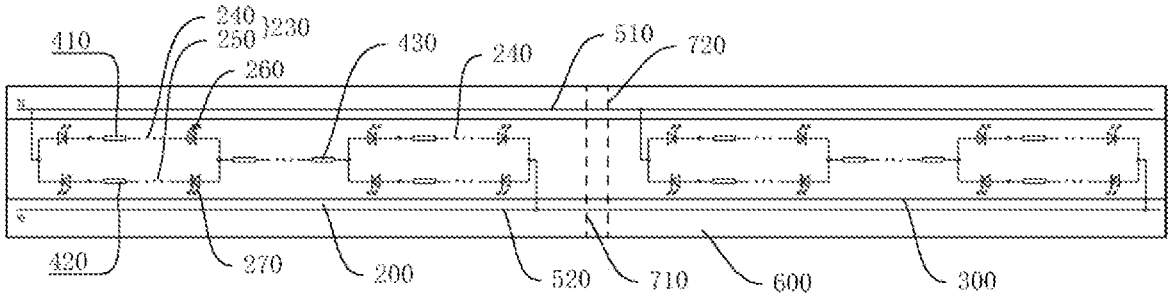
FIG. 3 is a schematic diagram of a circuit of the lamp strip of the present disclosure according to second embodiment.

In some embodiments of the present disclosure, as shown in FIG. 3, the first LED lamp bank 200 comprises a plurality of LED assemblies 230 sequentially connected in series, the LED assembly 230 comprises a first LED string circuit 240 and a second LED string circuit 250 connected in anti-parallel, the first LED string circuit 240 comprises a plurality of first LED beads 260 sequentially connected in series, the second LED string circuit 250 comprises a plurality of second LED beads 270 sequentially connected in series, and the first LED lamp bead 260 and the second LED lamp bead 270 emit different colors of light from each other.

In a similar way, the second LED lamp bank 300 comprises the plurality of LED assemblies 230 sequentially connected in series, the LED assembly 230 comprises the first LED string circuit 240 and the second LED string circuit 250 connected in anti-parallel, the first LED string circuit 240 comprises the plurality of first LED beads 260 sequentially connected in series, the second LED string circuit 250 comprises the plurality of second LED beads 270 sequentially connected in series, and the first LED lamp bead 260 and the second LED lamp bead 270 emit different colors of light from each other.

Specifically, a third resistor 430 is connected in series between at least two adjacent LED assemblies 230. As shown in FIG. 3, the third resistor 430 is connected in series between every two adjacent LED assemblies 230, so that currents passing through the first LED string circuit 240 and the second LED string circuit 250 may both pass through the third resistor 430. The third resistor 430 can play a role of limiting the currents, thus being able to protect operation of the first LED lamp bead 260 and the second LED lamp bead 270.

In some embodiments of the present disclosure, the first LED lamp bank 200 comprises a plurality of LED units sequentially connected in series, the LED unit comprises a first LED lamp bead 260 and a second LED lamp bead 270 which are connected in anti-parallel, and the first LED lamp bead 260 and the second LED lamp bead 270 emit different colors of light from each other.

In a similar way, the second LED lamp bank 300 comprises the plurality of LED units sequentially connected in series, the LED unit comprises the first LED lamp bead 260 and the second LED lamp bead 270 which are connected in anti-parallel, and the first LED lamp bead 260 and the second LED lamp bead 270 emit different colors of light from each other.

When processing the lamp strip, the first LED lamp bead 260 and the second LED lamp bead 270 may be processed to form the LED unit first, two welding feet are led out from the LED unit, and then the LED unit is arranged on the substrate 110 through the welding feet, so as to facilitate welding.

Figure 4:
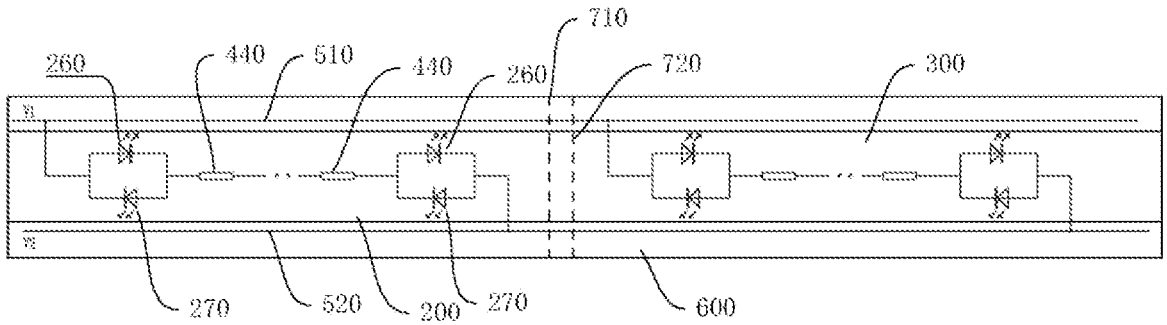
FIG. 4 is a schematic diagram of a circuit of the lamp strip of the present disclosure according to third embodiment.

In some embodiments of the present disclosure, a fourth resistor 440 is connected in series between at least two adjacent LED units. As shown in FIG. 4, the fourth resistor 440 is connected in series between every two adjacent LED units, thus further reducing a number of resistors.

In some embodiments of the present disclosure, the LED unit further comprises a dam arranged on the substrate 110 and a glue filling layer (not shown in the drawings), the first LED lamp bead 260 and the second LED lamp bead 270 are arranged in an area surrounded by the dam, and the glue filling layer covers the first LED lamp bead 260 and the second LED lamp bead 270. The glue filling layer may be made of a resin material to form a lens structure, and light emitted by the first LED lamp bead 260 and light emitted by the second LED lamp bead 270 can be fully mixed through the glue filling layer, thus improving a light-emitting effect.

Various technical features of the above embodiments may be combined randomly, and in order to simplify the description, possible combinations of various technical features in the above embodiments are not all described. However, as long as the combinations of these technical features have no contradiction, the combinations of these technical features should be considered as falling into the scope recorded by the specification.

Although the embodiments of the present disclosure have been shown and described, it can be understood by those of ordinary skills in the art that: various changes, modifications, substitutions and variations may be made to these embodiments without departing from the scope of the present disclosure, and the scope of the present disclosure is defined by the appended claims and their equivalents.

What is claimed is:

1. A shearable lamp strip, comprising:

a light-emitting body comprising a substrate, and a first LED lamp bank and a second LED lamp bank which are sequentially arranged on the substrate along a length direction of the substrate, wherein the first LED lamp bank comprises a first LED lamp string and a second LED lamp string which are connected in anti-parallel, and the first LED lamp string and the second LED lamp string emit different colors of light from each other;

a first bus and a second bus both arranged along the length direction of the substrate, wherein the first LED lamp bank is electrically connected with the first bus and the second bus respectively, and the second LED lamp bank is electrically connected with the first bus and the second bus respectively;

an outer sheath wrapped on the light-emitting body, the first bus and the second bus; and a shearing indication area arranged on the outer sheath and located between the first LED lamp bank and the second LED lamp bank, wherein the shearing indication area at least comprises a first shearing mark and a second shearing mark, and the first shearing mark and the second shearing mark are arranged at an interval along the length direction of the substrate.

2. The shearable lamp strip of claim 1, wherein the first bus and the second bus are respectively located at two sides of the length direction of the substrate, and a gap exists between the first bus and the substrate and a gap exists between the second bus and the substrate.

3. The shearable lamp strip of claim 1, wherein the first LED lamp string comprises a plurality of first LED lamp beads sequentially connected in series, the second LED lamp string comprises a plurality of second LED lamp beads sequentially connected in series, and the first LED lamp beads and the second LED lamp beads emit different colors of light from each other.

4. The shearable lamp strip of claim 1, wherein the first LED lamp bank comprises a plurality of LED units sequentially connected in series, each LED unit comprises a first LED lamp bead and a second LED lamp bead which are connected in anti-parallel, and each first LED lamp bead and each second LED lamp bead emit different colors of light from each other.

5. The shearable lamp strip of claim 3, wherein a first resistor is connected in series between at least two adjacent first LED lamp beads, and a second resistor is connected in series between at least two adjacent second LED lamp beads.

6. The shearable lamp strip of claim 4, wherein a fourth resistor is connected in series between at least two adjacent LED units.

7. A shearable lamp strip, comprising:

a light-emitting body comprising a substrate, and a first LED lamp bank and a second LED lamp bank which are sequentially arranged on the substrate along a length direction of the substrate;

a first bus and a second bus both arranged along the length direction of the substrate, wherein the first LED lamp bank is electrically connected with the first bus and the second bus respectively, and the second LED lamp bank is electrically connected with the first bus and the second bus respectively;

an outer sheath wrapped on the light-emitting body, the first bus and the second bus; and a shearing indication area arranged on the outer sheath and located between the first LED lamp bank and the second LED lamp bank, wherein the shearing indication area at least comprises a first shearing mark and a second shearing mark, and the first shearing mark and the second shearing mark are arranged at an interval along the length direction of the substrate;

wherein the first LED lamp bank comprises a plurality of LED assemblies sequentially connected in series, each LED assembly comprises a first LED string circuit and a second LED string circuit connected in anti-parallel, the first LED string circuit comprises a plurality of first LED beads sequentially connected in series, the second LED string circuit comprises a plurality of second LED beads sequentially connected in series, and the first LED lamp beads and the second LED lamp beads emit different colors of light from each other.

8. The shearable lamp strip of claim 7, wherein a third resistor is connected in series between at least two adjacent LED assemblies.

* * * * *